US011718449B2

(12) United States Patent
Payant et al.

(10) Patent No.: US 11,718,449 B2
(45) Date of Patent: Aug. 8, 2023

(54) BAG HAVING INTEGRAL HANDLE

(71) Applicant: AMCOR FLEXIBLES NORTH AMERICA, INC., Neenah, WI (US)

(72) Inventors: Michele C. Payant, Neenah, WI (US); Stephen J. Klein, Oshkosh, WI (US); Chad D. Cope, Neenah, WI (US)

(73) Assignee: Amcor Flexibles North America, Inc., Neenah, WI (US)

( * ) Notice: Subject to any disclaimer, the term of this patent is extended or adjusted under 35 U.S.C. 154(b) by 0 days.

(21) Appl. No.: 17/637,415

(22) PCT Filed: Aug. 29, 2019

(86) PCT No.: PCT/US2019/048753
§ 371 (c)(1),
(2) Date: Feb. 22, 2022

(87) PCT Pub. No.: WO2021/040715
PCT Pub. Date: Mar. 4, 2021

(65) Prior Publication Data

US 2022/0274742 A1 Sep. 1, 2022

(51) Int. Cl.
*B65D 33/08* (2006.01)

(52) U.S. Cl.
CPC ..... *B65D 33/08* (2013.01)

(58) Field of Classification Search
CPC ..... B65D 33/08
USPC ..... 383/10
See application file for complete search history.

(56) References Cited

U.S. PATENT DOCUMENTS

| | | | | |
|---|---|---|---|---|
| 4,555,025 | A | 11/1985 | Weinberg et al. | |
| 5,120,553 | A | 6/1992 | Kupcikevicius | |
| 5,286,503 | A | 2/1994 | Kupcikevicius | |
| 5,332,094 | A | 7/1994 | Cilia et al. | |
| 5,354,193 | A | 10/1994 | Kupcikevicius | |
| 5,464,285 | A * | 11/1995 | Anderson | B65D 75/5844 383/207 |
| 5,576,037 | A | 11/1996 | Moore, Jr. et al. | |
| 6,065,871 | A * | 5/2000 | Warr | B65D 33/08 383/903 |
| 6,176,613 | B1 | 1/2001 | Chen | |
| 6,260,705 | B1 | 7/2001 | Montepiani et al. | |
| 6,499,598 | B2 | 12/2002 | Montepiani et al. | |
| 8,794,836 | B2 | 8/2014 | Garavaglia et al. | |

(Continued)

FOREIGN PATENT DOCUMENTS

| | | |
|---|---|---|
| GB | 2339187 A | 1/2000 |
| WO | 2018169564 A1 | 9/2018 |

OTHER PUBLICATIONS

PCT International Search Report, International Application No. PCT/US2019/048753, dated Nov. 20, 2021, 3 pages.

*Primary Examiner* — Jes F Pascua

(57) ABSTRACT

A bag includes a header, a body, a seal positioned between the header and the body, and an integral handle. The integral handle includes a central portion, a first end portion including a first end first branch and a first end second branch, and a second end portion including a second end first branch and a second end second branch. The header includes a top end generally opposing the seal. The handle is positioned between the top end and the seal. The handle is perforated, scored or cut. The first end portion and the second end portion are located at each end of the central portion.

15 Claims, 7 Drawing Sheets

(56) References Cited

U.S. PATENT DOCUMENTS

| | | | | |
|---|---|---|---|---|
| 2004/0136619 | A1* | 7/2004 | Spork | B65D 33/02 383/88 |
| 2008/0128416 | A1 | 6/2008 | Odabashian | |
| 2010/0124386 | A1* | 5/2010 | Sturgis | B65D 75/5816 53/424 |
| 2010/0140127 | A1 | 6/2010 | Smith | |
| 2013/0094790 | A1 | 4/2013 | Garavaglia et al. | |
| 2015/0273783 | A1 | 10/2015 | Copp et al. | |
| 2017/0225841 | A1 | 8/2017 | Sale et al. | |
| 2019/0135514 | A1 | 5/2019 | Huerta et al. | |

* cited by examiner

BAG HAVING INTEGRAL HANDLE

TECHNICAL FIELD

The present application is related to the field of bags and specifically those having integral handles.

BACKGROUND

Bags are commonly used for packaging various products, such as food items and non-food items. In some applications, shrink bag packaging is used for food, such as meat or cheese, as well as other items including non-food. In some shrink bag applications, the bags are typically pre-manufactured with a top seal and header incorporating various features such as handles or seals to prevent curling. The bags are often manufactured from multilayer polymer films that are highly engineered to provide properties such as oxygen barrier, abuse resistance, ability to seal through contamination, etc. It may also be desirable to have bags that have handles for manually lifting or carrying the bags.

For many applications, it is desired to have bags that can be manually torn open for removal of the product. Current tear-open bags often suffer from premature tearing of the handles prior to opening of a product package. Handles can commonly be in the form of finger holes or other shapes that can be removed or punched out from the bag. Current handle designs generally produce additional waste and require disposal of the removed or punched out portions. Bags that include punched out portions run the risk of the punched out portion being included within the sealed package that can pose a safety concern, for example, choking, if the punched out portion is packaged with food. Further, bag materials in a shrink-packaging application are shrunk, where the handles or finger holes are reduced in size, rendering the handles inaccessible to a user. The bag may be difficult to open because there is not an adequate area for the user to grasp onto the bag in order to open it. Consequently, the user often times resorts to the use of sharp objects such as scissors, knives, etc. that can also pose safety concerns, especially in a manufacturing setting. Additionally, current tear-open shrink bags suffer from inconsistent performance when the tear propagates to or through the seal area and the tear follows either the leading or trailing bead of the main seal to the edge of the bag. As a result, the bag may not open at all (tears above the seal) or it is not opened enough to empty the product from the bag.

Thus, a need exists for bags that can be handled (e.g., lifted and/or carried by a handle) without premature tearing of the handle and that can also be easily opened by tearing that allows for product removal.

SUMMARY

A bag has been developed with an integral handle having a tear feature. The design of the handle may prevent unwanted tearing of the handle prior to opening of the bag. The handle may also be easily accessible to a user for lifting the bag. The handle can be manufactured without generating additional waste.

One embodiment of the bag includes a header, a body, a seal positioned between the header and the body, and an integral handle. The integral handle includes a central portion, a first end portion including a first end first branch and a first end second branch, and a second end portion including a second end first branch and a second end second branch. The header includes a top end generally opposing the seal.

The handle is positioned between the top end and the seal. The handle is perforated, scored or cut. The first end portion and the second end portion are located at each end of the central portion.

In some embodiments, the header includes a height that includes a maximum distance between the top end of the header and the seal. The handle is positioned from 10 percent to 90 percent of the height of the header from the seal.

In some embodiments, the handle is positioned along a longitudinal center line of the header. In some other embodiments, the handle is offset from the longitudinal center line of the header.

In some embodiments, the handle includes a first side and a second side generally opposing the first side, and a width that includes a maximum distance between the first and the second side. The central portion of the handle includes from 15 percent to 85 percent of the width of the header.

In some embodiments, the bag further includes a first end angle between the first end first branch and the first end second branch, and a second end angle between the second end first branch and the second end second branch between 0 degrees and 180 degrees.

In some embodiments, the first branch and the second branch of the first end portion or the second end portion are of different lengths. In some other embodiments, the first branch and the second branch of the first end portion or the second end portion are of equal lengths.

In some embodiments, the bag further includes an end position seal positioned over a terminating end of the first end first branch, the first end second branch, the second end first branch, and/or the second end second branch.

In some embodiments, the bag is a shrink bag. In some other embodiments, the bag is a tube. In yet other embodiments, the bag is a pouch.

In some embodiments, the bag further includes a package opening position. A first separation is made at either the first end first branch or the second end first branch. A second separation is made at the opposing second end second branch or the first end second branch, respectively. The second separation propagates along or through the seal and into the body.

One embodiment of a shrink bag includes a header, a body, a seal positioned between the header and the body, and an integral handle. The integral handle includes a central portion, a first end portion including a first end first branch and a first end second branch, and a second end portion including a second end first branch and a second end second branch. The handle is positioned in the header. The handle is perforated, scored or cut. The first end portion and the second end portion are located at each end of the central portion. The handle includes an angle between the first end first branch and the first end second branch or the second end first branch and the second end second branch between 0 degrees and 180 degrees.

In some embodiments, the shrink bag further includes an end portion seal positioned over a terminating end of the first end first branch, the first end second branch, the second end first branch, and/or the second end second branch.

One embodiment of a packaged product includes a header, a body, a first seal positioned between the header and the body, a product within the body, a second seal positioned on the body opposite the first seal, and an integral handle. The integral handle includes a central portion, a first end portion including a first end first branch and a first end second branch, and a second end portion including a second end first branch and second end second branch. The product is positioned in the body between the first seal and the second seal. The handle is positioned in the header. The handle is perforated, scored or cut. The first end position and the second end portion are located at each end of the central portion. In some embodiments, the product is a food item.

One embodiment of a method of opening a packaged product includes forming a packaged product including a header including a grip portion and a remaining portion, a body, a first seal positioned between the header and the body, a product within the body, a second seal positioned on the body opposite the first seal, and an integral handle including a central portion, a first end portion including a first end first branch and a first end second branch and a second end portion including a second end first branch and a second end second branch. The method further includes separating the header at either the first end first branch or the second end first branch. The method further includes separating the grip portion from the remaining portion at either the second end second branch or the first end second branch, respectively, such that the separation propagates along or through the first seal. The product within the body is positioned between the first seal and the second seal. The handle is positioned in the header portion. The handle is perforated, scored or cut. The first end portion and the second end position are located at each end of the central portion.

There are several aspects of the present subject matter which may be embodied separately or together. These aspects may be employed alone or in combination with other aspects of the subject matter described herein, and the description of these aspects together is not intended to preclude the use of these aspects separately or the claiming of such aspects separately or in different combinations.

BRIEF DESCRIPTION OF THE DRAWINGS

The disclosure may be more completely understood in consideration of the following detailed description of various embodiments of the disclosure in connection with the accompanying drawings, in which.

The figures are not necessarily to scale. Like numbers used in the figures refer to like components. It will be understood, however, that the use of a number to refer to a component in a given figure is not intended to limit the component in another figure labeled with the same number.

DETAILED DESCRIPTION

The present application describes a bag and a packaged product including the bag. The bag includes a header, a body, a seal positioned between the header and the body, and an integral handle. The integral handle includes a central portion, a first end portion including a first end first branch and a first end second branch, and a second end portion including a second end first branch and a second end second branch. The header includes a top end generally opposing the seal. The handle is positioned between the top end and the seal. The handle is perforated, scored or cut. The first end portion and the second end portion are located at each end of the central portion. The handle may be resistant to unwanted tearing prior to opening of the bag. The handle may also allow easy tearing of the bag to provide access to the contents of the bag. The handle may also be easily accessible to a user for lifting the bag. The handle can be manufactured without generating additional waste. This is in contrast to current bags having handles that often tear prematurely prior to opening, and therefore create difficulties in opening and require additional effort or equipment to remove the contents of the bag, such as the use of knives, scissors or other sharp objects. Current handles often shrink after shrink packaging operations and are therefore not easily accessible. Current handles also generate additional waste and/or safety concerns during manufacture, for example removal of material (chads) for finger holes that may be accidentally contained within the final package.

Figure 1:
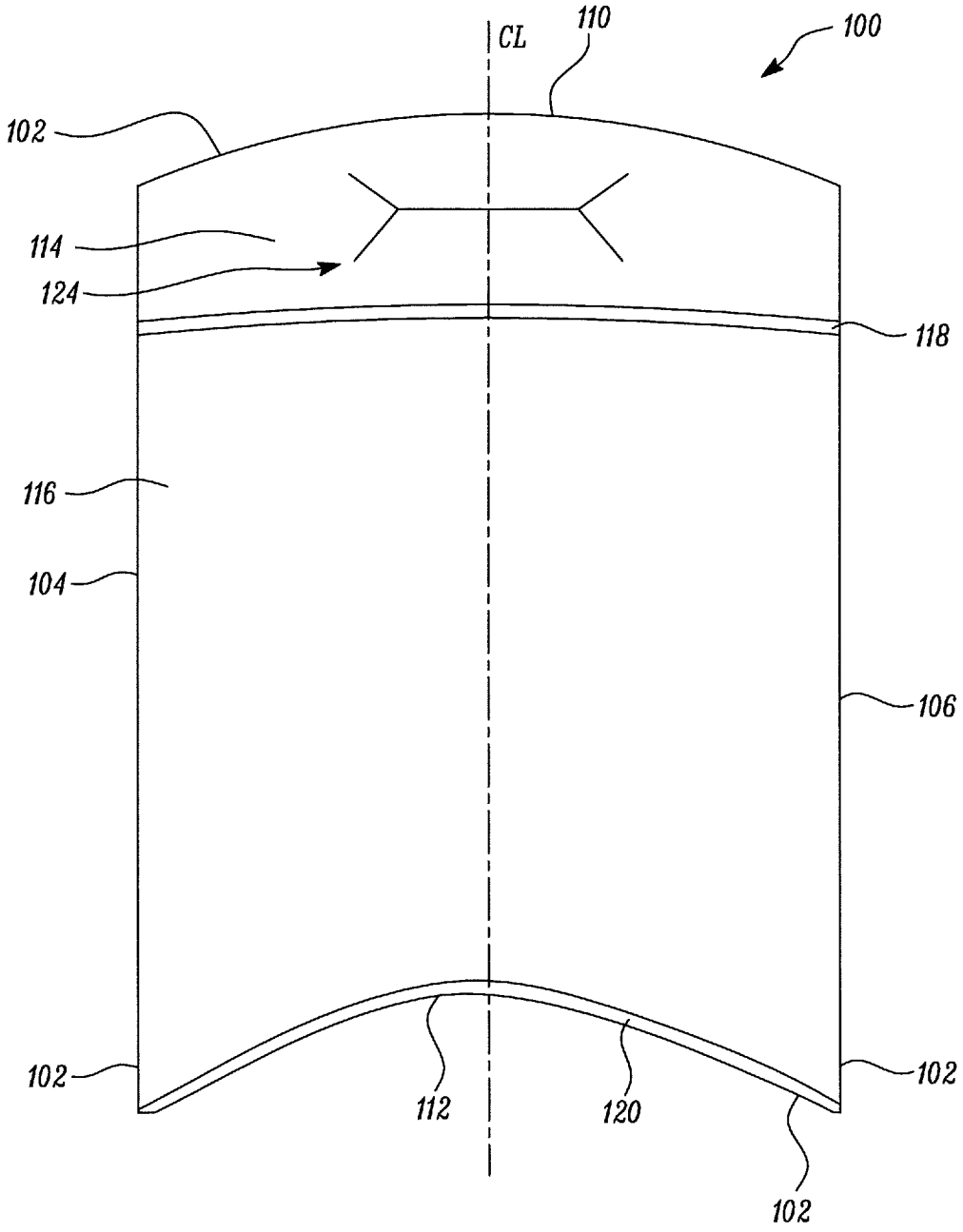
FIG. 1 is a schematic top view of an exemplary bag.

FIG. 1 is a schematic top view of a first embodiment of a bag 100 according to the present application. Bag 100 can be any type of container. In some other embodiments, bag 100 is a pouch. In yet other embodiments, bag 100 is a tube. In some embodiments, bag 100 is a shrink bag. Bag 100 includes a perimeter 102 including a first edge 104, a second edge 106 opposing first edge 104, a top end 110 inclined to first edge 104 and second edge 106, and a bottom end 112 opposing top end 110. In some embodiments, top end 110 can be substantially perpendicular to first and second edges 104, 106. Similarly, bottom end 112 can be substantially perpendicular to first and second edges 104, 106. As depicted in FIG. 1, each of first and second edges 104, 106 is substantially linear, while each of top and bottom ends 110, 112 is arcuate. Bag 100 may therefore be substantially torpedo shaped. However, bag 100 is not limited to this shape. In other embodiments, bag 100 may be of various shapes, including rectangle, square, parallelogram, etc.

Bag 100 further includes a header 114, a body 116, and a first seal 118 positioned between header 114 and body 116. Bag 100 further includes a second seal 120 positioned on body 116 opposite first seal 118. As depicted in FIG. 1, second seal 120 is positioned at bottom end 112 of bag 100. In an alternative embodiment, second seal 120 may be spaced apart from bottom end 112. First and second seals 118, 120 may be formed by heat, impulse, ultrasonic, pressure or other seal-forming methods. As depicted in FIG. 1, first seal 118 is substantially linear, while second seal 120 is arcuate. However, the shapes of first and second seals 118, 120 may vary based on the configuration of bag 100.

In some embodiments, bag 100 may be made of one or more multilayer films. As a non-limiting example, bag 100 may include two walls. Each wall may be a multilayer film. Further, the walls may be sealed at their respective sealant layers by first and second seals 118, 120. In alternative embodiments, bag 100 includes a pouch or a tube made of a multilayer film.

A product (not shown in FIG. 1) is received within body 116. Body 116 may define a product space for receiving the product. Product space may be defined between first seal 118 and second seal 120. The product is therefore positioned in body 116 between first seal 118 and second seal 120. In some embodiments, the product is a food item, for example, cheese. Bag 100 along with the product received within body 116 form a packaged product. In an embodiment, bag 100 may be a shrink bag where the bag 100 may be subjected to heat such that bag 100 is shrunk and in close contact with the product.

Header 114 includes an integral handle 124. Header 114 further includes top end 110 generally opposing first seal 118. Handle 124 is positioned between top end 110 and first seal 118. In an embodiment, header 114 may further include a top seal at top end 110 generally opposing first seal 118.

Figure 2:
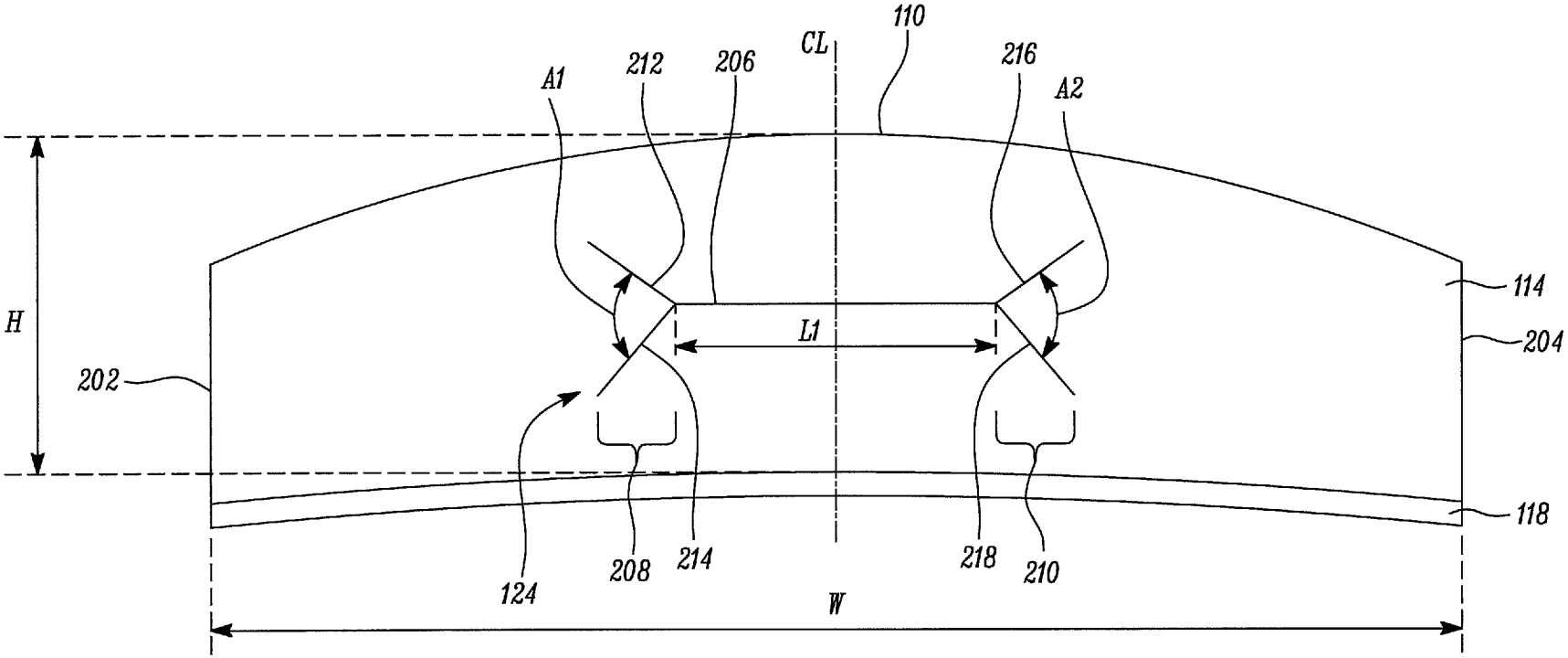
FIG. 2 is a schematic top view of a header of the bag of FIG. 1.

FIG. 2 is a schematic top view of header 114 of bag 100. Header 114 includes a first side 202 and a second side 204 generally opposing first side 202. First side 202 coincides with first edge 104 (shown in FIG. 1) of bag 100. Similarly, second side 204 coincides with second edge 106 (shown in FIG. 1) of bag 100. Header 114 further includes a width "W" that includes a maximum distance between first side 202 and second side 204. Header 114 further includes a height "H" that includes a maximum distance between top end 110 of header 114 and first seal 118. Header 114 further defines a longitudinal center line "CL".

Handle 124 is perforated, scored or cut. In some cases, handle 124 may include a slit formed in header 114. Handle 124 may permit more efficient use of material because waste material is not generated during manufacture of handle 124. For example, some current handles include portions of material that are cut, e.g., a hanging chad, or are removed, e.g., a chad. In some embodiments, handle 124 is positioned along longitudinal center line "CL" of header 114. In some other embodiments, handle 124 is offset from longitudinal center line "CL" of header 114. Handle 124 further includes a central portion 206, a first end portion 208, and a second end portion 210. First and second end portions 208, 210 are located at opposing ends of central portion 206. Central portion 206 of handle 124 includes from 15 percent to 85 percent of width "W" of header 114 or any percent therebetween. In some embodiments, central portion 206 of handle 124 is from 20 percent to 80 percent, 25 percent to 75 percent, 30 percent to 70 percent, 35 percent to 65 percent, 40 percent to 60 percent, or 45 percent to 55 percent of width "W" of header 114. Specifically, central portion 206 of handle 124 includes from 20 percent to 25 percent of width "W" of header 114. Further, central portion 206 of handle 124 is positioned from 10 percent to 90 percent of height "H" of header 114 from seal 118 or any percent therebetween. In some embodiments, central portion 206 of handle 124 is positioned from 15 percent to 85 percent, 20 percent to 80 percent, 25 percent to 75 percent, 30 percent to 70 percent, 35 percent to 65 percent, 40 percent to 60 percent, or 45 percent to 55 percent, of height "H" of header 114 relative to seal 118. Specifically, central portion 206 of handle 124 is positioned from 20 percent to 50 percent of height "H" of header 114 relative to seal 118.

First end portion 208 includes a first end first branch 212 and a first end second branch 214. Similarly, second end portion 210 includes a second end first branch 216 and a second end second branch 218. First end first branch 212 and first end second branch 214 may be interchangeably referred to as first branch 212 and second branch 214, respectively. Further, second end first branch 216 and second end second branch 218 may be interchangeably referred to as first branch 216 and second branch 218, respectively. In some embodiments, first branch 212, 216 and second branch 214, 218 of first end portion 208 or second end portion 210 may be of equal lengths. In some other embodiments, first branch 212, 216 and second branch 214, 218 of first end portion 208 or second end portion 210 may be of different lengths.

Handle 124 includes a first end angle "A1" between first end first branch 212 and first end second branch 214. Header 114 further includes a second end angle "A2" between second end first branch 216 and second end second branch 218. In some embodiments, first end angle "A1" is between 0 degrees and 180 degrees. In some embodiments, second end angle "A2" is between 0 degrees and 180 degrees. In some embodiments, first and second end angles "A1", "A2" may be between 10 degrees and 170 degrees, 20 degrees and 160 degrees, 30 degrees and 150 degrees, 40 degrees and 140 degrees, 50 degrees and 130 degrees, 60 degrees and 120 degrees, 70 degrees and 110 degrees, and 80 degrees and 100 degrees. In some embodiments, first and second end angles "A1", "A2" may be equal to each other. In some other embodiments, first and second end angles "A1", "A2" may be different from each other. As a non-limiting example, first and second end angles "A1", "A2" are approximately 45 degrees. As a non-limiting example, lengths of first branches 212, 216 and second branches 214, 216 are approximately from 0.6 cm to 1.3 cm (0.25 in to 0.50 in). However, lengths may be chosen that are appropriate for the particular bag, pouch, tube, or package.

In some embodiments, header 114 may further include an end portion seal (not shown in FIG. 2) positioned over or in close proximity to a terminating end of first end first branch 212, first end second branch 214, second end first branch 216, and/or second end second branch 218. The end portion seal may prevent unwanted tearing from the first end first branch 212, first end second branch 214, second end first branch 216, and/or second end second branch 218 until the package is to be opened by a user. The end portion seal may be formed by heat, impulse, ultrasonic, pressure or other seal-forming methods.

As depicted in FIG. 2, each of central portion 206, first end first branch 212, first end second branch 214, second end first branch 216, and second end second branch 218 is substantially linear. In other embodiments, one or more of central portion 206, first end first branch 212, first end second branch 214, second end first branch 216, and second end second branch 218 may be arcuate.

In some embodiments, a length "L1" of central portion 206 may be less than or equal to 5.1 cm (2 in). Length "L1" of central portion 206 may be chosen based on various parameters. As a non-limiting example, length "L1" of central portion 206 may be based on a desired size of an opening from which the product can be removed when bag 100 is opened. A lower value of length "L1" of central portion 206 may provide a larger opening from which the product can be removed when bag 100 is opened. As a further non-limiting example, length "L1" of central portion 206 may be based on a desired size of handle 124 in case bag 100 is composed of shrink material. Further, the branched design of handle 124 may produce a large and easily accessible handle when bag 100 is shrunk. The branched design may also prevent unwanted handle tear initiation before bag 100 is opened. Tearing of bag 100 may be controlled by handle 124. For example, tearing of bag 100 may take place through first end first branch 212 and second end second branch 218, or through second end first branch 216 and first end second branch 214. In some cases, a first separation may be made at either first end first branch 212 or second end first branch 216, and a second separation may be made at opposing second end second branch 218 or first end second branch 214, respectively. The second separation may further propagate along or through first seal 118 and into body 116.

Figure 3B:
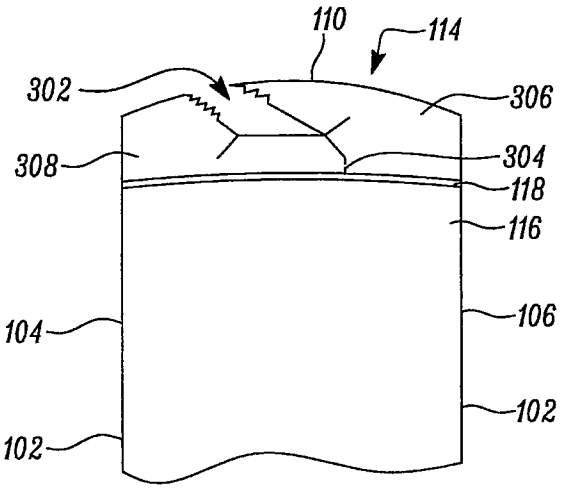
FIGS. 3A-3C are exemplary opening configurations of the bag.
Figure 3A:
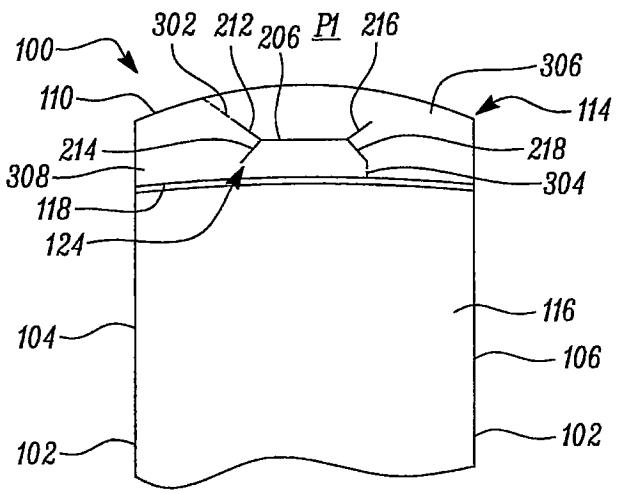
Figure 3C:
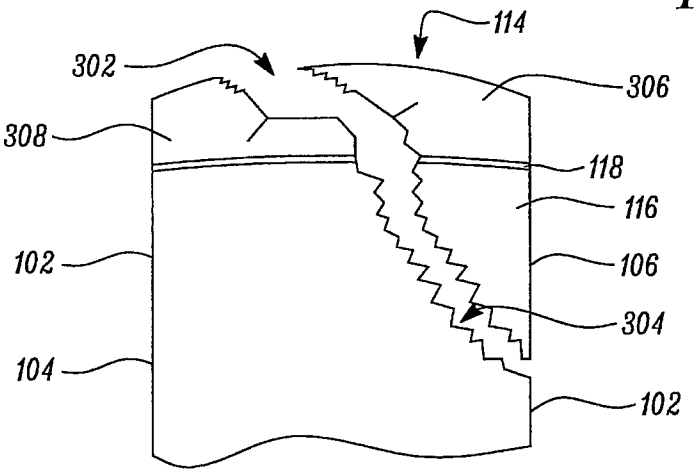

FIGS. 3A, 3B, and 3C illustrate an exemplary method of opening bag 100. Bag 100 includes a package opening position "P1". As depicted in FIG. 3A, a first separation 302 is made at first end first branch 212. First separation 302 further extends from top end 110 of header 114. Further, a second separation 304 is made at opposing second end second branch 218. Second separation 304 propagates along or through first seal 118 and into body 116. FIG. 3B shows tearing of bag 100 along first separation 302. Header 114 is separated at first end first branch 212 and at central portion 206. FIG. 3C shows tearing along second separation 304. Header 114 is separated at second end second branch 218. Header 114 further includes a grip portion 306 and a remaining portion 308. Grip portion 306 may be used for further tearing of bag 100 along or through first seal 118 and through body 116 by providing the user with an amount of material to grasp onto. Grip portion 306 is separated from remaining portion 308 along first and second separations 302, 304 and central portion 206 of handle 124. Handle 124 may facilitate tearing of header 114 along first and second separations 302, 304 resulting in the separation of grip portion 306 from remaining portion 308. As depicted in FIG. 3C, second separation 304 may propagate through body 116 to perimeter 102 of bag 100 at second edge 106. In other embodiments, second separation 304 may propagate through body 116 to perimeter 102 of bag 100 at bottom end 112 or towards perimeter 102 of bag 100 at bottom end 112.

The method of opening bag 100, as shown in FIGS. 3A-3C, is exemplary in nature and there can be alternative methods of opening bag 100 within the scope of the present application. In some cases, first separation 302 ending at top end 110 may be aligned with first end first branch 212. In some other cases, a portion of first separation 302 between top end 110 and handle 124 may be inclined to first end first branch 212. Moreover, first separation 302 may be linear, curved, or a combination thereof. Second separation 304 may be inclined or aligned with second end second branch 218. In some cases, second separation 304 may be parallel to longitudinal center line "CL" (shown in FIG. 2). Further, second separation 304 may be linear, curved, or a combination thereof. Second separation 304 may propagate to second edge 106 or to bottom end 112 of body 116.

Figure 4:
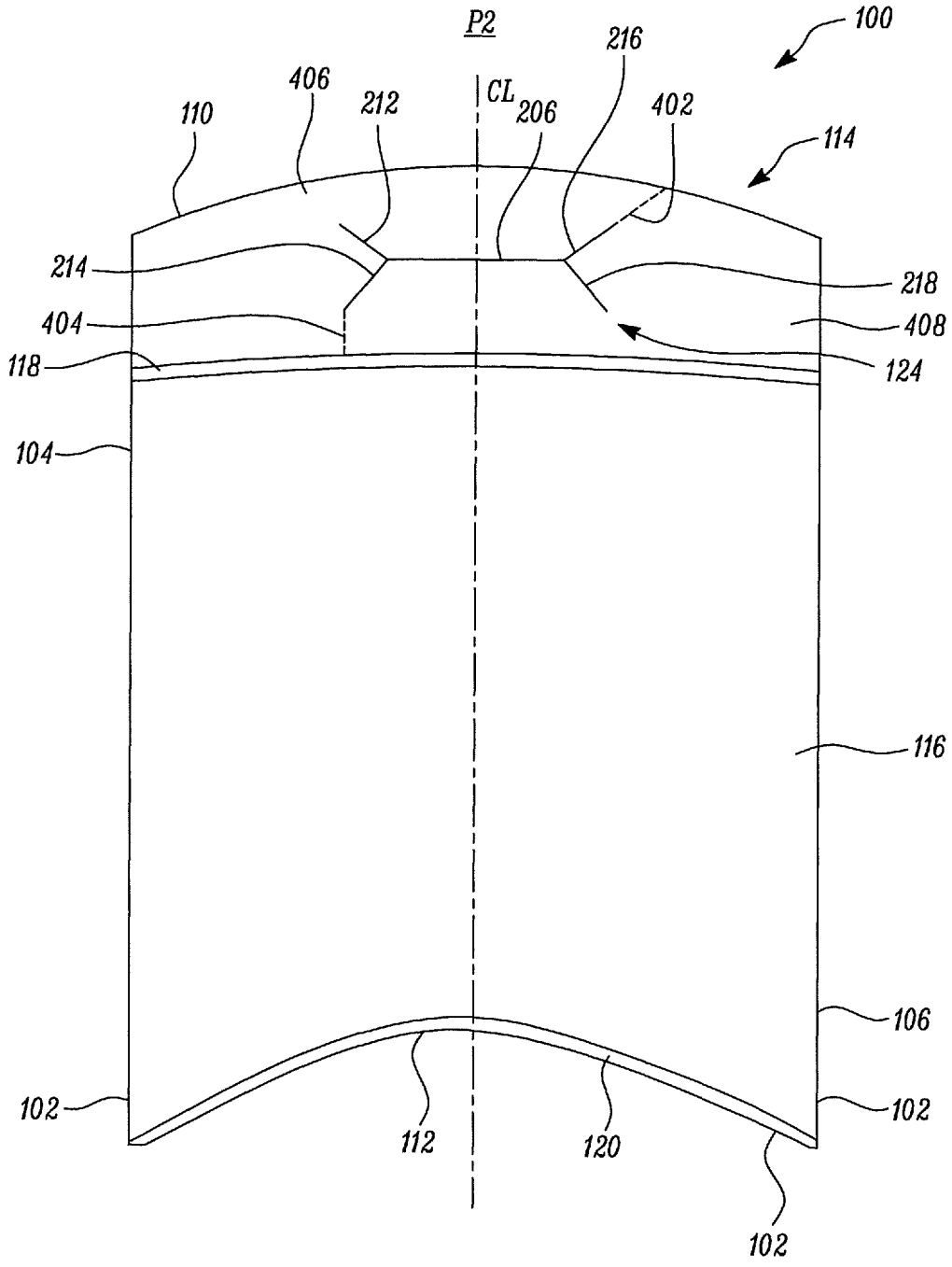
FIG. 4 is another exemplary opening configuration of the bag.

FIG. 4 depicts an alternative configuration of opening bag 100. A package opening position "P2" is shown in FIG. 4. As depicted in FIG. 4, a first separation 402 is made at second end first branch 216. Further, a second separation 404 is made at opposing first end second branch 214. Second separation 404 may propagate along or through first seal 118 and into body 116. Bag 100 includes a grip portion 406 and a remaining portion 408. It should be noted that grip portion 406 and remaining portion 408, as shown in FIG. 4, are reversed relative to grip portion 306 and remaining portion 308, as shown in FIG. 3C.

Referring to FIGS. 3A-3B and 4, a packaged product including bag 100 and a product can be formed such that header 114 includes grip portion 306 or 406 and remaining portion 308 or 408. A method of opening the packaged product may include separating header 114 at either first end first branch 212 or second end first branch 216. The method may further include separating grip portion 306 or 406 from remaining portion 308 or 408 at either second end second branch 218 or first end second branch 214, respectively, such that the separation propagates along or through first seal 118. FIGS. 3A-3B depict opening via first end first branch 212 and second end second branch 218.

Figure 5:
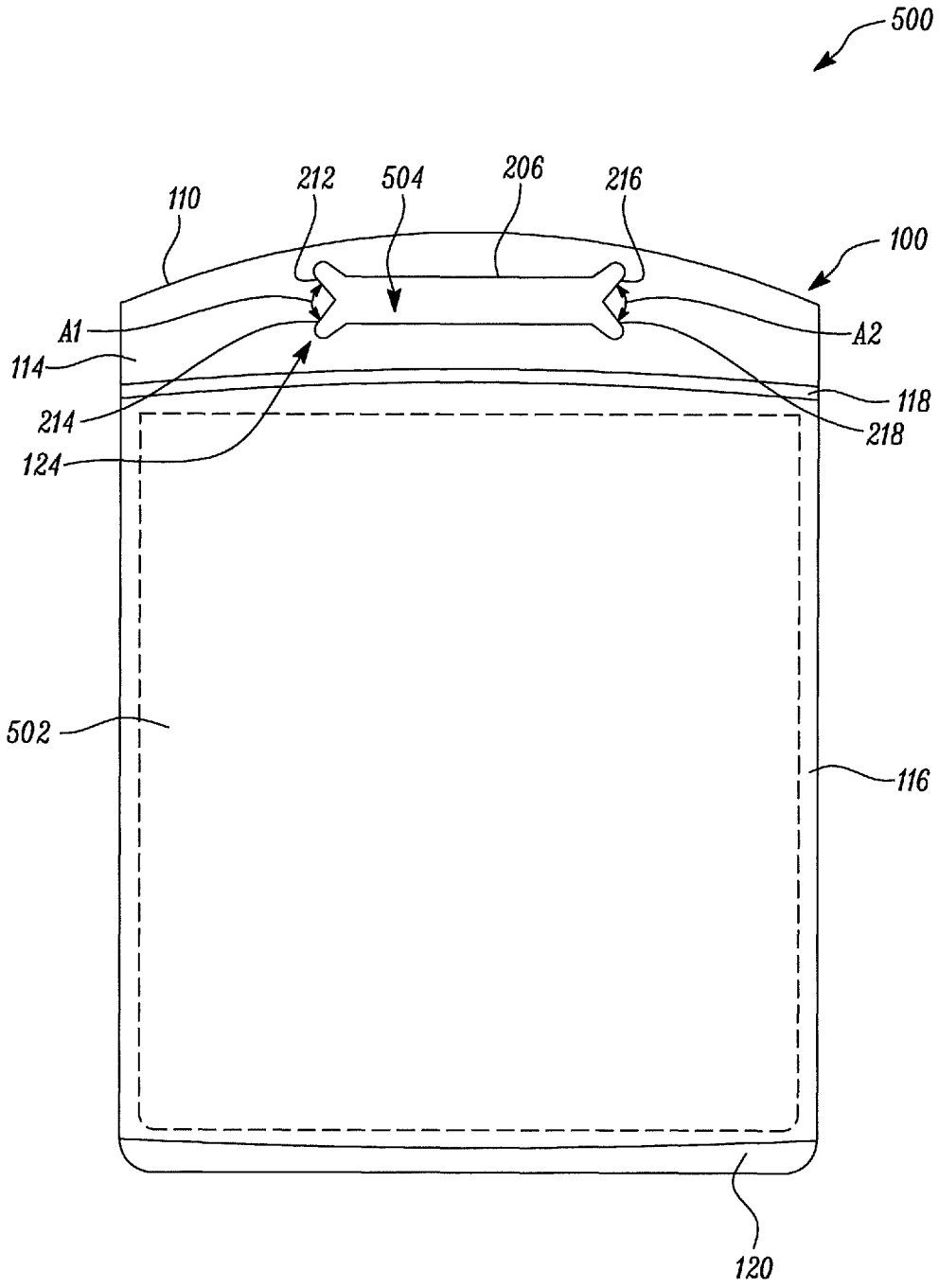
FIG. 5 is a schematic top view of a packaged product.

FIG. 5 shows a packaged product 500 including bag 100 and a product 502 within body 116. Product 502 is positioned between first seal 118 and second seal 120. Bag 100 is depicted in a shrunken state in FIG. 5. First and second end angles "A1", "A2" may increase in the shrunken state of bag 100. Handle 124 produces a handle opening 504 in the shrunken state of bag 100. Handle opening 504 may be large and easily accessible, e.g., for an adult hand. Handle opening 504 may allow insertion of a user's hand to grasp handle 124 and lift packaged product 500. Handle 124 may prevent unwanted and premature tearing of header 114 prior to opening of bag 100. Further, handle 124 may also facilitate tearing of header 114 and body 116, as discussed above with reference to FIGS. 3A-3B and 4.

Figure 6:
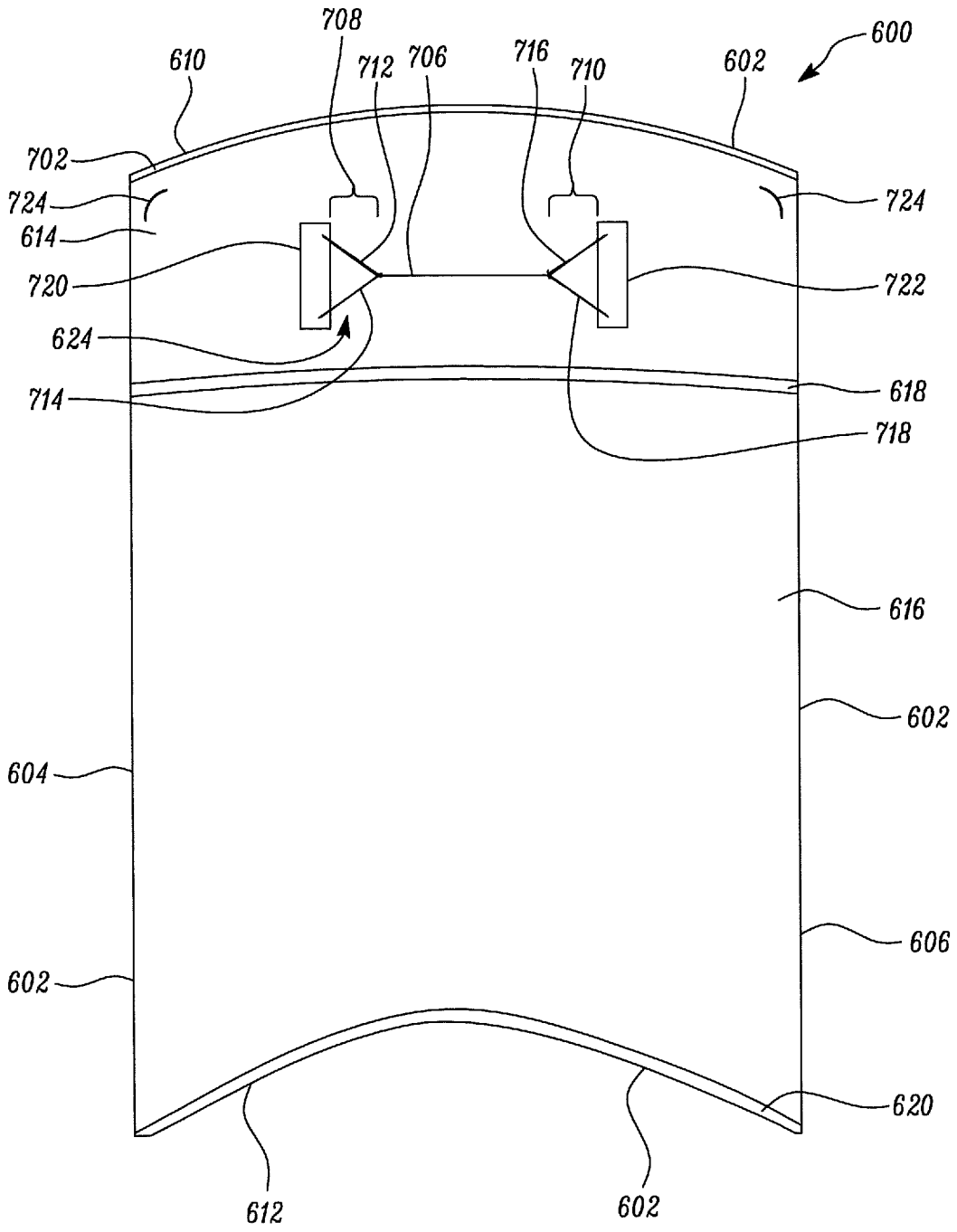
FIG. 6 is a schematic top view of another exemplary bag.

FIG. 6 depicts a schematic top view of a bag 600 according to another embodiment of the present application. Bag 600 is substantially similar to bag 100, and includes a header 614, a body 616, a first seal 618, a second seal 620 and a handle 624. Bag 600 further includes a perimeter 602, a first edge 604, a second edge 606, a top end 610 and a bottom end 612. Body 616 defines a product space. Bag 600 may include a third seal 702 at top end 610, as shown in FIG. 6. In other embodiments, third seal 702 may be positioned anywhere between the top end 610 and the first seal 618. Third seal 702 may be incorporated, especially in shrink packaging applications, to connect the walls of header 614 to each other and to prevent the walls from curling away from each other during and post shrink operations. Third seal 702 may be substantially opposite to first seal 618. Third seal 702 may be a continuous or non-continuous seal. Third seal 702 may include linear and/or arcuate portions. Third seal 702 may be formed by heat, impulse, ultrasonic, pressure or other seal-forming methods.

Additionally, bag 600 may include supplemental seal 724. The bag 600 may include one or more supplemental seals 724. Two supplemental seals 724 are shown in FIG. 6 that are eyebrow shaped. Supplemental seal 724 may be positioned anywhere between the top end 610 and the first seal 618. Supplemental seal 724 may, especially in shrink packaging applications, connect the walls of header 614 and prevent the walls from curling away from each other during and post shrink operations. Supplemental seal 724 may be a continuous or non-continuous seal. Supplemental seal 724 may be any shape (e.g., linear, arcuate, circle, rectangle, etc.). Supplemental seal 724 may be formed by heat, impulse, ultrasonic, pressure or other seal-forming methods. In some embodiments, bag 600 may include a third seal 702, a supplemental seal 724, or combinations thereof. Additionally, bag 600 may be opened in a similar manner as bag 100, as described above with reference to FIGS. 3A-3B and 4.

Handle 624 includes a central portion 706, a first end portion 708, and a second end portion 710. First end portion 708 includes a first end first branch 712 and a first end second branch 714. Similarly, second end portion 710 includes a second end first branch 716 and a second end second branch 718. Bag 600 further includes a first end portion seal 720 positioned over terminating ends of first end first branch 712 and first end second branch 714. Bag 600 also includes a second end portion seal 722 positioned over terminating ends of second end first branch 716 and second end second branch 718. However, in alternative embodiments, an end portion seal can be positioned over the terminating end of first end first branch 712, first end second branch 714, second end first branch 716, and/or second end second branch 718. Further, each of first and second end portion seals 720, 722 may be rectangular, curved, circular, etc. First and second end portion seals 720, 722 may be formed by heat, impulse, ultrasonic, pressure or other seal-forming methods. First and second end portion seals 720, 722 may prevent unwanted and premature tearing of handle 624.

Figure 7:
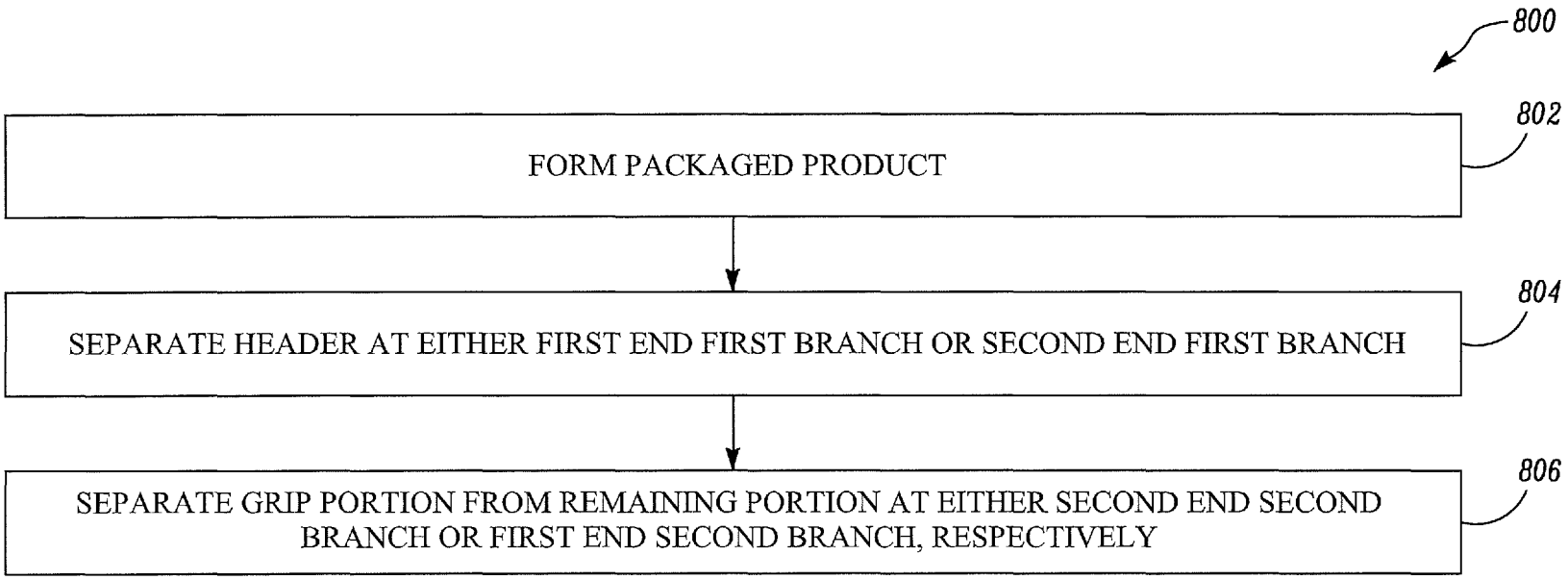
FIG. 7 is an exemplary flowchart of a method of opening a bag.

FIG. 7 illustrates a method 800 of opening a packaged product. Method 800 will be described with reference to FIGS. 1, 2, 3A-3B, 4 and 5. At step 802, method 800 includes forming packaged product 500 including header 114 including grip portion 306 or 406 and a remaining portion 308 or 408, body 116, first seal 118 positioned between header 114 and body 116, product 502 within body 116, second seal 120 positioned on body 116 opposite first seal 118, and integral handle 124 positioned in header 114. Product 502 is positioned within body 116 between first seal 118 and second seal 120. Integral handle 124 includes central portion 206, first end portion 208 including first end first branch 212 and first end second branch 214, and second end portion 210 including second end first branch 216 and second end second branch 218. First and second end portions 208, 210 are located at each end of central portion 206. Handle 124 is perforated, scored, or cut.

At step 804, method 800 further includes separating header 114 at either first end first branch 212 or second end first branch 216.

At step 806, method 800 further includes separating grip portion 306 or 406 from remaining portion 308 or 408 at either second end second branch 218 or first end second branch 214, respectively, such that the separation propagates along or through first seal 118.

Bags 100, 600, described above, may be made of one or more heat shrinkable films. As used throughout this application, a "heat-shrinkable film" is a film having a machine direction shrinkage value of greater than 5 percent shrink at 90° C. and a transverse direction shrinkage value of greater than 5 percent shrink at 90° C. As used throughout this application, the term "machine direction" or "MD" refers to the direction of film transport during or after extrusion or film conversion. For the bag described in the present application, such direction corresponds to the direction from the bottom end of the bag to the top end (as described above). As such, as used throughout this application, the term "machine direction shrinkage" refers to shrinkage in a direction from the bottom end of the bag to the top end. As used throughout this application, the term "transverse direction" or "TD" refers to the direction perpendicular to the machine direction (such as, for the present application, a direction from the first edge of the bag to the second edge). As used throughout this application, the term "shrinkage value" refers to values obtained by measuring unrestrained (or free) shrink of a ten-centimeter square sample immersed in water at 90° C. (or the indicated temperature if different) for five seconds, in such method, four test specimens are cut from a given sample of the film to be tested. The specimens are cut into squares of ten-centimeter length in the machine direction by ten-centimeter length in the transverse direction. Each specimen is completely immersed for five seconds in a 90° C. (or the indicated temperature if different) water bath. The specimen is then removed from the bath and the distance between the ends of the shrunken specimen is measured for both the machine and transverse directions. The difference in the measured distance for the shrunken specimen and the original ten-centimeter side is multiplied by ten to obtain the percent of shrinkage for the specimen in each direction.

Bags 100, 600 may include one or more monolayer or multilayer heat-shrinkage films. Each heat-shrinkage film may have (1) a machine direction shrinkage value of greater than 5 percent shrink at 90° C. or from greater than 5 percent to 70 percent shrink at 90° C. or at least 10 percent shrink at 90° C. or at least 20 percent shrink at 90° C. or from 10 percent to 50 percent shrink at 90° C.; and (2) a transverse direction shrinkage value of greater than 5 percent shrink at 90° C. or from greater than 5 percent to 70 percent shrink at 90° C. or at least 10 percent shrink at 90° C. or at least 20 percent shrink at 90° C. or from 10 percent to 50 percent shrink at 90° C.

Each film may include polypropylene, polyethylene, polyamide, polyester, polystyrene, cyclic olefin copolymer, ethylene vinyl-alcohol copolymer, polyvinylidene chloride, monomer, or blends of such.

As used throughout this application, the term "polypropylene" or "PP" refers to a plastomer, homopolymer or copolymer having at least one propylene monomer linkage within the repeating backbone of the polymer. The propylene linkage may be represented by the general formula: $[CH_2CH(CH_3)]_n$. Such polypropylene may be a polypropylene impact copolymer, a polypropylene random copolymer, or a polypropylene homopolymer, may be syndiotactic or isotactic, or may or may not be clarified.

As used throughout this application, the term "polyethylene" or "PE" refers (unless indicated otherwise) to ethylene homopolymers or copolymers. Such copolymers of ethylene include copolymers of ethylene with at least one alpha-olefin and copolymers of ethylene with other units or groups such as vinyl acetate, acid groups, acrylate groups, or otherwise. The term "polyethylene" or "PE" is used without regard to the presence or absence of substituent branch groups. PE includes, for example, medium density polyethylene, high density polyethylene, low density polyethylene, ethylene phenol and copolymer, ethylene vinyl acetate, ethylene acid copolymers, ethylene acrylate copolymers, or blends of such. Various PEs may be recycled as reclaimed PE.

As used throughout this application, the term "high density polyethylene" or "HDPE" refers to both (a) homopolymers of ethylene which have densities from 0.960 g/cm$^3$ to 0.980 g/cm$^3$ and (b) copolymers of ethylene and an alpha-olefin (usually 1-butene or 1-hexene) which have densities from 0.940 g/cm$^3$ to 0.958 g/cm$^3$. HDPE includes polymers made with Ziegler or Phillips type catalysts and polymers made with single site metallocene catalysts. HDPE also includes high molecular weight "polyethylenes".

As used throughout this application, the term "low density polyethylene" or "LDPE" refers to branched homopolymers having densities from 0.915 g/cm3 to 0.930 g/cm$^3$ as well as copolymers containing polar groups resulting from copolymerization (such as with vinyl acetate or ethyl acrylate). LDPE may contain long branches off the main chain (often termed "backbone") with alkyl substituents of two to eight carbon atoms.

As used throughout this application, the terms "copolymer of ethylene and at least one alpha-olefin" or "ethylene alpha-olefin copolymer" refer to a modified or unmodified copolymer produced by the co-polymerization of ethylene and any one or more alpha-olefins. Suitable alpha-olefins include, for example, $C_3$ to $C_{20}$ alpha-olefins such as 1-propene, 1-butene, 1-pentene, 1-hexene, 1-octene, 1-decene and blends of such. The co-polymerization of ethylene and an alpha-olefin may be produced by heterogeneous catalysis, such as co-polymerization reactions with Ziegler-Natta catalysis systems, including, for example, metal halides activated by an organometallic catalyst (e.g., titanium chloride) and optionally containing magnesium chloride complexed to trialkyl aluminum. Alternatively, the co-polymerization of ethylene and an alpha-olefin may be produced by homogeneous catalysis, such as co-polymerization reactions with metallocene catalysis systems which include constrained geometry catalysts (e.g., monocyclopentadienyl transition-metal complexes). Homogeneous catalyzed copolymers of ethylene and alpha-olefin may include modified or unmodified ethylene alpha-olefin copolymers having a long-chain branched (i.e., 8-20 pendant carbons atoms) alpha-olefin co-monomer (commercially available as, for example, Affinity™ from The Dow Chemical Company (Midland, Mich.)), linear copolymers (commercially available as, for example, Tafmer™ from the Mitsui Petrochemical Corporation (Tokyo, Japan)), and modified or unmodified ethylene alpha-olefin copolymers having a short-chain branched (i.e., 3-6 pendant carbons atoms) alpha-olefin co-monomer (commercially available as, for example, Exact™ from ExxonMobil Chemical Company (Houston, Tex.)). Ethylene alpha-olefin copolymers may include, for example, linear low density polyethylene (LLDPE), metallocene-catalyzed LLDPE (mLLDPE), very low density polyethylene (VLDPE), metallocene-catalyzed VLDPE (mVLDPE), and ultra low density polyethylene (ULDPE).

As used throughout this application, the term "ethylene vinyl acetate" or "EVA" refers to copolymers comprised of repeating units of ethylene and vinyl acetate. Ethylene vinyl acetate copolymers may be represented by the general formula: $[(CH_2—CH_2)_n—((CH_2—CH(COO)(CH_3))_m]$. The vinyl acetate content may vary from less than 10 percent to greater than 95 percent by weight (of total EVA composition). The vinyl acetate content of EVA for packaging applications may vary from 5 percent to 40 percent by weight.

As used throughout this application, the term "ethylene acid copolymers" refers to copolymers comprised of repeating units of ethylene and acid groups. The acid group content may vary from 2 percent to 25 percent by weight. Non-limiting examples of ethylene acid copolymers include ethylene methacrylic acid (EMAA) and ethylene acrylic acid (EAA).

As used throughout this application, the term "ethylene acrylate copolymers" refers to copolymers comprised of repeating units of ethylene and acrylate groups. The acrylate group may be butyl-, ethyl-, methyl-, or otherwise. Non-limiting examples of ethylene acrylate copolymers include ethylene methyl acrylate (EMA) and ethylene methyl methacrylate (EMMA).

As used throughout this application, the term "polyamide" or "PA" or "nylon" refers to a homopolymer or copolymer having an amide linkage between monomer units and formed by any method known in the art. Recurring amide linkages may be formed by the reaction of one or more diamines and one or more diacids. Non-limiting examples of suitable diamines include 1,4-diamino butane, hexamethylene diamine, decamethylene diamine, metaxylylene diamine and isophorone diamine. Non-limiting examples of suitable diacids include terephthalic acid, isophthalic acid, 2,5-furandicarboxylic acid, succinic acid, adipic acid, azelaic acid, capric acid and lauric acid.

Polyamides may also be formed by the ring-opening polymerization of suitable cyclic lactams like ε-caprolactam, ω-undecanolactam and ω-dodecalactam.

Non-limiting examples of suitable polyamides include poly(ε-caprolactam) (nylon 6), poly(ω-undecanolactam) (nylon 11), poly(ω-dodecalactam) (nylon 12), poly(hexamethylene adipamide) (nylon 6,6), poly(hexamethylene adipamide-co-caprolactam) (nylon 66/6), poly(caprolactam-co-hexamethylene adipamide) (nylon 6/66), poly(caprolactam-co-hexamethylene azelamide) (nylon 6/69), poly(m-xylylene adipamide) (MXD6) and poly(hexamethylene terephthalamide-co-hexamethylene isophthalamide) (nylon 6I/6T).

As used throughout this application, the term "polyester" refers to homopolymers and copolymers having recurring ester linkages which may be formed by any method known in the art. Recurring ester linkages may be formed by the reaction of one or more diols with one or more diacids. Non-limiting examples of suitable diols include ethylene glycol, diethylene glycol, 1,3-propanediol, 1,4-butanediol, resorcinol, 1,4-cyclohexanedimethanol, 2,2,4,4-tetramethyl-1,3-cyclobutanediol, and polyoxytetramethylene glycol. Non-limiting examples of suitable diacids include terephthalic acid, isophthalic acid, 2,6-naphthalene dicarboxylic acid, 2,5-furandicarboxylic acid, 1,4-cyclohexane dicarboxylic acid, trimellitic anhydride, succinic acid, adipic acid and azelaic acid.

Non-limiting examples of suitable polyesters include poly(ethylene terephthalate) (PET), poly(ethylene terephthalate-co-cyclohexanedimethanol terephthalate) (PETG), poly(butylene terephthalate) (PBT), poly(ethylene naphthalate) (PEN), poly(ethylene furanoate) (PEF), polypropylene furanoate) (PPF) and poly(butylene adipate-co-terephthalate) (PBAT).

Suitable polyesters may also be formed by the ring-opening polymerization of suitable cyclic monomers like lactides to form, for example, poly(lactic acid) (PLA), glycolides to form, for example, poly(glycolic acid) (PGA) and lactones to form, for example, poly(caprolactone) and poly(butyrolactone).

Suitable polyesters may also be formed by the direct condensation reaction of alpha hydroxy acids. For example, PGA may be formed by the condensation reaction of glycolic acid.

Suitable polyesters may also be synthesized by microorganisms. Examples of suitable polyesters include various poly(hydroxy alkanoates) like poly(hydroxy butyrate) (PHB) and poly(hydroxy valerate) (PHV).

As used throughout this application, the term "polystyrene" or "PS" or "styrenic polymer" refers to a homopolymer or copolymer having at least one styrene monomer linkage (such as benzene (i.e., $C_6H_6$) having an ethylene substituent) within the repeating backbone of the polymer. The styrene linkage may be represented by the general formula: $[CH_2—CH_2(C_6H_5)]_n$. Examples of styrenic polymers include but are not limited to high impact polystyrene (HIPS), general purpose polystyrene (GPPS) and styrene butadiene copolymer (SBC).

As used throughout this application the term "cyclic olefin copolymer" or "COC" refers to a class of polymeric materials based on cyclic olefin monomers and ethane, with one or more different cyclic olefin units randomly or alternately attached to an ethylene polymer backbone. Ethylene/norbornene copolymers are a non-limiting example of cyclic olefin copolymers.

As used throughout this application, the term "ethylene vinyl alcohol copolymer" or "EVOH" refers to copolymers comprised of repeating units of ethylene and vinyl alcohol. Ethylene vinyl alcohol copolymers may be represented by the general formula: [(CH2-CH2)n-(CH2-CH(OH))m]. Ethylene vinyl alcohol copolymers may include saponified or hydrolyzed ethylene vinyl acetate copolymers. In commercial grades of EVOH, the extent of saponification is very high, such that the presence of any unsaponified vinyl acetate groups is typically ignored. The EVOH composition is usually expressed in terms of its ethylene content and for commercial grades used in packaging applications, the ethylene content may range from 27 mole percent to 48 mole percent, though even broader compositions are produced for other applications.

As used throughout this application, the term "polyvinylidene chloride" or "PVDC" refers to a homopolymer or copolymer having at least one vinylidene chloride monomer linkage within the repeating backbone of the polymer. The vinylidene chloride linkage may be represented by the general formula $[CH_2—CCl_2]_n$. As a copolymer, PVDC may have a major amount of vinylidene chloride and a minor amount of one or more monomers such as vinyl chloride or alkyl acrylates (such as methyl acrylates).

As used throughout this application, "ionomer" refers to ionic copolymers formed from an olefin and an ethylenically unsaturated monocarboxylic acid having the carboxylic acid moieties partially or completely neutralized by a metal ion. Suitable metal ions may include, but are not limited to, sodium, potassium, lithium cesium, nickel, and zinc. Suitable carboxylic acid comonomers may include, but are not limited to, ethylene acid copolymers, such as, ethylene methacrylic acid, methylene succinic acid, maleic anhydride, vinyl acetate methacrylic acid, methyl methacrylate methacrylic acid, styrene methacrylic acid, and blends of such. Useful ionomer ethylene/acid copolymer resins may include an olefinic content of at least 50 mole percent based upon the copolymer and a carboxylic acid content of from 5 to 25 mote percent based upon the copolymer.

As used throughout this application, the term "copolymer" refers to a polymer product obtained by the polymerization reaction or copolymerization of at least two monomer species. Copolymers may also be referred to as bipolymers. The term "copolymer" is also inclusive of the polymerization reaction of three, four or more monomer species having reaction products referred to terpolymers, quaterpolymers, etc.

As used throughout this application, the term "modified" refers to a chemical derivative, such as one having any form of anhydride functionality (e.g., anhydride of maleic acid, crotonic acid, citraconic acid, itaconic acid, fumaric acid, etc.), whether grafted onto a polymer, copolymerized with a polymer or blended with one or more polymers. The term is also inclusive of derivatives of such functionalities, such as acids, esters and metal salts derived from such.

Each wall of bag 100 or 600 includes a sealant film or sealant layer. As used throughout this application, the term "sealant film" refers to a film included in a package or film and involved in the sealing of the package or film to itself or to another layer of another film, sheet, etc. The term "sealant layer" or "sealant layers" refers to the specific layer or layers of the film or the sealant film involved in the sealing to itself or to another layer. A sealant film may be monolayer or multilayer. If the sealant film is monolayer, the term "sealant film" is synonymous with the term "sealant layer". A sealant film may be a blown film sealant, an extrusion coated sealant, or a heat seal lacquer. Specific non-limiting examples of sealant layers included in each wall include but are not limited to layers comprising polyethylene (such as LLDPE, a blend of LLDPE and LDPE, mLLDPE), polypropylene (such as a blend of random copolymer PP and PP plastomer), ionomer, or blends of any of the above.

Each wall that includes a heat-shrinkage film includes a sealant film (or sealant layer), in some embodiments, each wall includes materials providing a ratio of TD tear to MD tear pre shrink of greater than 2.7, a ratio of TD tear to MD tear post shrink of greater than 1.0, a ratio of MD tear post shrink to MD tear pre shrink of less man 36, or a ratio of TD tear post shrink to TD pre shrink of less than 13 (as further described below).

A specific non-limiting method of making the bag described in the present application includes producing materials for each wall (such as by blown co-extrusion with appropriate draw ratios to produce desired shrink properties and with optional irradiation via electron beam or otherwise) and producing bags with such materials (such as via bag-making equipment known in the art).

The bags produced may be used in a variety of applications, including packaging food and non-food items. Non-limiting examples of food Items that may be packaged in the shrink bag described in the present application include meats and cheeses, including but not limited to large cuts of meat and large blocks of cheese. A further non-limiting example of a food item is meat (such as ham) that is cooked in the package prior to sale to the end-user.

Each and every document cited in this present application, including any cross referenced, is incorporated in this present application in its entirety by this reference, unless expressly excluded or otherwise limited. The citation of any document is not an admission that it is prior art with respect to any embodiment disclosed in this present application or that it alone, or in any combination with any other reference or references, teaches, suggests, or discloses any such embodiment. Further, to the extent that any meaning or definition of a term in this present application conflicts with any meaning or definition of the same term in a document incorporated by reference, the meaning or definition assigned to that term in this present application governs.

The drawings show some but not all embodiments. The elements depicted in the drawings are illustrative and not necessarily to scale, and the same (or similar) reference numbers denote the same (or similar) features throughout the drawings.

The description, examples, embodiments, and drawings disclosed are illustrative only and should not be interpreted as limiting. The present invention includes the description, examples, embodiments, and drawings disclosed; but it is not limited to such description, examples, embodiments, or drawings. As briefly described above, the reader should assume that features of one disclosed embodiment can also be applied to all other disclosed embodiments, unless expressly indicated to the contrary. Modifications and other embodiments will be apparent to a person of ordinary skill in the packaging arts, and all such modifications and other embodiments are intended and deemed to be within the scope of the present invention.

The invention claimed is:

1. A bag comprising:

a header;

a body;

a seal positioned between the header and the body;

an integral handle comprising a central portion, a first end portion comprising a first end first branch and a first end second branch and a second end portion comprising a second end first branch and a second end second branch; and a package opening position;

wherein the header comprises a top end generally opposing the seal;

wherein the handle is positioned between the top end and the seal; wherein the handle is perforated, scored or cut; wherein the first end portion and the second end portion are located at each end of the central portion; wherein a first separation is made at either the first end first branch or the second end first branch; wherein a second separation is made at the opposing second end second branch or the first end second branch, respectively; and wherein the second separation propagates along or through the seal and into the body.

2. The bag of claim 1, wherein the header comprises a height that includes a maximum distance between the top end of the header and the seal and wherein the handle is positioned from 10 percent to 90 percent of the height of the header from the seal.

3. The bag of claim 2, wherein the handle is positioned along a longitudinal center line of the header.

4. The bag of claim 2, wherein the handle is offset from a longitudinal center line of the header.

5. The bag of claim 1, wherein the header comprises a first side and a second side generally opposing the first side and a width that includes a maximum distance between the first side and the second side and wherein the central portion of the handle comprises from 15 percent to 85 percent of the width of the header.

6. The bag of claim 1, further comprising a first end angle between the first end first branch and the first end second branch and a second end angle between the second end first branch and the second end second branch between 0 degrees and 180 degrees.

7. The bag of claim 1, wherein the first branch and the second branch of the first end portion or the second end portion are of different lengths.

8. The bag of claim 1, wherein the first branch and the second branch of the first end portion or the second end portion are of equal lengths.

9. The bag of claim 1, further comprising an end portion seal positioned over a terminating end of the first end first branch, the first end second branch, the second end first branch, and/or the second end second branch.

10. The bag of claim 1, wherein the bag is a shrink bag.

11. The bag of claim 1, wherein the bag is a tube.

12. The bag of claim 1, wherein the bag is a pouch.

13. A packaged product comprising:

a header;

a body;

a first seal positioned between the header and the body;

a product within the body;

a second seal positioned on the body opposite the first seal;

an integral handle comprising a central portion, a first end portion comprising a first end first branch and a first end second branch and a second end portion comprising a second end first branch and a second end second branch; and a package opening position;

wherein the product is positioned in the body between the first seal and the second seal; wherein the handle is positioned in the header; wherein the handle is perforated, scored or cut; wherein the first end portion and the second end portion are located at each end of the central portion; wherein a first separation is made at either the first end first branch or the second end first branch; wherein a second separation is made at the opposing second end second branch or the first end second branch, respectively; and wherein the second separation propagates along or through the seal and into the body.

14. The packaged product of claim 13, wherein the product is a food item.

15. A method of opening a packaged product comprising:

forming a packaged product comprising a header comprising a grip portion and a remaining portion; a body; a first seal positioned between the header and the body; a product within the body; a second seal positioned on the body opposite the first seal; and an integral handle comprising a central portion, a first end portion comprising a first end first branch and a first end second branch and a second end portion comprising a second end first branch and a second end second branch;

separating the header at either the first end first branch or the second end first branch; and separating the grip portion from the remaining portion at either the second end second branch or the first end second branch, respectively, such that the separation propagates along or through the first seal;

wherein the product within the body is positioned between the first seal and the second seal; wherein the handle is positioned in the header; wherein the handle is perforated, scored or cut; and wherein the first end portion and the second end portion are located at each end of the central portion.

* * * * *